US006631568B2

(12) United States Patent
Howlett et al.

(10) Patent No.: US 6,631,568 B2
(45) **Date of Patent: *Oct. 14, 2003**

(54) INSOLE FOR FITNESS AND RECREATIONAL WALKING

(75) Inventors: Harold Howlett, Nesbit, MS (US); David O. Foshee, Bartlett, TN (US); Phillip C. Yang, Memphis, TN (US); Laura Crane, Williston, TN (US)

(73) Assignee: Schering-Plough Healthcare Products, Inc., Memphis, TN (US)

( * ) Notice: Subject to any disclaimer, the term of this patent is extended or adjusted under 35 U.S.C. 154(b) by 30 days.

This patent is subject to a terminal disclaimer.

(21) Appl. No.: 09/919,016

(22) Filed: Jul. 31, 2001

(65) Prior Publication Data

US 2003/0024134 A1 Feb. 6, 2003

(51) Int. Cl.[7] ..... A43B 13/38

(52) U.S. Cl. ..... 36/43; 36/91; 36/28; 36/145; 36/173

(58) Field of Search ..... 36/43, 44, 88, 36/91, 92, 71, 28, 37, 140, 166, 173, 178, 181; D2/955, 953, 954, 961

(56) References Cited

U.S. PATENT DOCUMENTS

| | | | | | |
|---|---|---|---|---|---|
| 2,928,193 | A | * | 3/1960 | Kristan | 36/178 |
| 4,081,917 | A | * | 4/1978 | Bradley et al. | 36/76 R |
| D259,595 | S | * | 6/1981 | Famolare, Jr. | D2/955 |
| 4,387,516 | A | | 6/1983 | Laux | |
| 4,435,910 | A | | 3/1984 | Marc | |
| 4,486,964 | A | | 12/1984 | Rudy | |
| 4,557,060 | A | | 12/1985 | Kawashima | |
| 4,571,852 | A | * | 2/1986 | Lamarche et al. | 36/32 R |
| 4,619,056 | A | * | 10/1986 | Lin et al. | 36/145 |
| 4,627,179 | A | | 12/1986 | McElroy | |
| 4,686,994 | A | * | 8/1987 | Harr et al. | 36/145 |
| 4,760,655 | A | | 8/1988 | Mauch | |
| 4,841,647 | A | | 6/1989 | Turucz | |
| 4,862,606 | A | * | 9/1989 | Siskind et al. | 36/77 M |
| 5,488,786 | A | | 2/1996 | Ratay | |
| 5,517,770 | A | | 5/1996 | Martin | |
| 5,542,196 | A | | 8/1996 | Kantro | |
| 5,551,173 | A | | 9/1996 | Chambers | |
| 5,638,613 | A | | 6/1997 | Williams | |
| 5,749,111 | A | | 5/1998 | Pearce | |
| 5,766,704 | A | | 6/1998 | Allen | |
| 5,960,566 | A | | 10/1999 | Brown | |
| 5,994,450 | A | | 11/1999 | Pearce | |
| 6,026,527 | A | | 2/2000 | Pearce | |
| 6,038,793 | A | | 3/2000 | Kendall | |
| 6,131,310 | A | | 10/2000 | Fang | |
| 6,173,511 | B1 | | 1/2001 | Perrault | |
| 6,301,805 | B1 | * | 10/2001 | Howlett et al. | 36/145 |

* cited by examiner

*Primary Examiner*—J. Mohandesi
(74) *Attorney, Agent, or Firm*—Robert J. Lipka

(57) ABSTRACT

An insole includes a forefoot portion having a lower first recess; a cupped heel portion having a lower second recess; a mid-foot portion connecting together the forefoot portion and the heel portion, the mid-foot portion including a medial arch portion, and the forefoot, heel and mid-foot portions formed from a unitary resilient material; a plurality of protuberances in the second recess and having lower edges generally coplanar with a lower surface of the heel portion in surrounding relation to the second recess; a plurality of spaced apart spring walls formed from a viscoelastic gel in the first recess, the spring walls having lower edges generally coplanar with a lower surface of the forefoot portion which is in surrounding relation to the first recess; and a shell extending under the mid-foot portion and made of a resilient material that is stiffer than the unitary resilient material.

8 Claims, 2 Drawing Sheets

INSOLE FOR FITNESS AND RECREATIONAL WALKING

BACKGROUND OF THE INVENTION

The present invention relates generally to shoe insoles, and more particularly, to improved insoles particularly adapted for fitness and recreational walking.

According to an article in Footwear News, volume 53, number 26, page 10, research performed in 1996 by the National Sporting Goods Association indicates that Americans are using exercise walking more than any other activity as a form of physical activity. The article further notes that since 1985, the physical activity of walking for exercise increased from 41.4 million to 73.7 million exercise walkers, with the largest number of such exercise walkers ranging in age from 33 to 54 years old. Approximately seven million senior citizens, aged 55 and older, walk for fitness, making walking the number one exercise activity for senior citizens. Also of significance is the fact that treadmill use has become the second most favored activity, with approximately 36 million users in 1997.

Although there are a wide variety of shoe types that can be used to facilitate participation in fitness or recreational walking, a closer inspection of these shoes reveals that the original equipment insert is generally a flat ethylene vinyl acetate (EVA) foam material having a thickness of approximately 175 mils. However, after repeated use, even as little as eight or nine times using the footwear, the EVA foam material will compression set approximately 40 to 50%, thereby losing a significant portion of its cushioning ability. Further, the EVA foam insert generally does not provide sufficient arch support and provides little or no heel cradling effect.

In contrast, a number of insoles have been designed for vigorous sports, and thereby utilize materials which are engineered to absorb the shock of high impact activities. These sport insoles therefore mainly focus on providing shock attenuation and motion control in the heel.

In addition, walking provides very different effects than vigorous sports. Specifically, while walking imparts impacts to the heel of up to one and one-half times a person's body weight on the shoe, running provides impacts of up to two to three times the person's body weight on the shoe. In contrast, walking provides more dwell time in both the heel and the forefoot than running.

Therefore, it is desirable for walking to provide an insole that, while providing shock absorption and spring in the heel, also provides a substantial amount of cushion and sheer absorption to the user's forefoot, and which is primarily directed to fitness and recreational walking.

SUMMARY OF THE INVENTION

Accordingly, it is an object of the present invention to provide an insole that overcomes the aforementioned problems.

It is another object of the present invention to provide an insole for fitness and recreational walking.

It is still another object of the present invention to provide an insole that will not compression set to a large degree over time.

It is yet another object of the present invention to provide an insole having thin and spaced apart elastic and resilient spring walls that are formed in a repeating order within a recess formed in the toe portion, and which are elastic and provide the function of a quick acting spring.

It is a further object of the present invention to provide an insole in which the spring walls are formed in a spiral pattern and reduce shear during a normal gait.

It is a still further object of the present invention to provide an insole in which the spring walls are made of a gel material.

It is a yet further object of the present invention to provide an insole having a thin shell at the underside of the mid-foot portion, and which is composed of a more rigid or stiffer material than the lower cushioning layer and provides extra support and aids the foot in normal pronation.

It is another object of the present invention to provide an insole in which the thin shell is formed from a thermoplastic composite formed primarily from filaments of fiberglass embedded in a thermoplastic material.

It is still another object of the present invention to provide an insole with an oval opening at the underside of the heel portion which includes equally spaced apart small protuberances, which provide a quicker acting spring than the remainder of the insole, but with less dampening energy absorption.

It is yet another object of the present invention to provide an insole that is easy and economical to make and use.

In accordance with an aspect of the present invention, a removable insole for insertion into footwear, includes a forefoot portion extending at least to the metatarsals of a foot; a cupped heel portion including a relatively flat central portion and a sloped side wall surrounding the relatively flat central portion; a mid-foot portion connecting together the forefoot portion and the heel portion, the mid-foot portion including a medial arch portion defined by an extension of the sloped side wall, and the forefoot portion, heel portion and mid-foot portion formed from a unitary resilient material; a recess in a lower surface of the forefoot portion, the recess having a peripheral side wall and a top wall; a shell that extends along an underside of the insole, the shell extending under the mid-foot portion, the shell being made of a resilient material that is stiffer than the unitary resilient material; and a plurality of spaced apart spring walls formed from a viscoelastic gel in the recess, the spring walls having lower edges generally coplanar with a lower surface of the forefoot portion which is in surrounding relation to the recess.

Preferably, the spaced apart spring walls are formed in a spiral shape and extend under the forefoot portion at a position where all the metatarsal heads are adapted to apply pressure thereto. In this regard, the recess occupies a greater lateral to medial area at a front thereof than at a rear thereof. The spring walls extend substantially in an anterior to posterior direction from a rear portion of the recess to a front portion of the recess, and extend substantially in a medial to lateral direction at the front portion of the recess. Preferably, the spring walls that are at a medial side of the insole extend at an inclination to the anterior to posterior direction so as to have a substantially anterior to posterior component, but also a medial to lateral component.

The shell is preferably made from a thermoplastic composite polymer formed primarily from filaments of fiberglass embedded in a thermoplastic material, and extends to a higher extent on a medial side of the mid-foot portion than at a lateral side of the mid-foot portion. Preferably, the unitary resilient material at the mid-foot portion is formed with a shallow recess at an underside thereof, and the shell is adhered in the shallow recess such that a lower surface of the shell forms a continuation of a lower surface of a remainder of the mid-foot portion surrounding the shallow recess.

In accordance with another aspect of the present invention, a removable insole for insertion into footwear, includes a forefoot portion extending at least to the metatarsals of a foot; a cupped heel portion including a relatively flat central portion and a sloped side wall surrounding the relatively flat central portion; a mid-foot portion connecting together the forefoot portion and the heel portion, the mid-foot portion including a medial arch portion defined by an extension of the sloped side wall, and the forefoot portion, heel portion and mid-foot portion formed from a unitary resilient material; a shell that extends along an underside of the insole, the shell extending under the mid-foot portion, the shell being made of a resilient material that is stiffer than the unitary resilient material; a recess at an undersurface of the cupped heel portion; and a plurality of protuberances in the recess, the protuberances forming spaced apart spring walls and the first protuberances having lower edges generally coplanar with a lower surface of the heel portion in surrounding relation to the recess.

Preferably, the first protuberances have a generally cylindrical configuration.

In accordance with still another aspect of the present invention, a removable insole for insertion into footwear, includes a forefoot portion extending at least to the metatarsals of a foot; a cupped heel portion including a relatively flat central portion and a sloped side wall surrounding the relatively flat central portion; a mid-foot portion connecting together the forefoot portion and the heel portion, the mid-foot portion including a medial arch portion defined by an extension of the sloped side wall, and the forefoot portion, heel portion and mid-foot portion formed from a unitary resilient material; a first recess at an undersurface of the cupped heel portion; a plurality of protuberances in the first recess, the protuberances forming spaced apart spring walls and the first protuberances having lower edges generally coplanar with a lower surface of the heel portion in surrounding relation to the first recess; a second recess in a lower surface of the forefoot portion; and a plurality of spaced apart spring walls formed from a viscoelastic gel in the second recess, the spring walls having lower edges generally coplanar with a lower surface of the forefoot portion which is in surrounding relation to the second recess.

In accordance with yet another aspect of the present invention, a removable insole for insertion into footwear, includes a forefoot portion extending at least to the metatarsals of a foot; a cupped heel portion including a relatively flat central portion and a sloped side wall surrounding the relatively flat central portion; a mid-foot portion connecting together the forefoot portion and the heel portion, the mid-foot portion including a medial arch portion defined by an extension of the sloped side wall, and the forefoot portion, heel portion and mid-foot portion formed from a unitary resilient material; a first recess at an undersurface of the cupped heel portion; a plurality of protuberances in the first recess, the protuberances forming spaced apart spring walls and the first protuberances having lower edges generally coplanar with a lower surface of the heel portion in surrounding relation to the first recess; a second recess in a lower surface of the forefoot portion; a plurality of spaced apart spring walls formed from a viscoelastic gel in the second recess, the spring walls having lower edges generally coplanar with a lower surface of the forefoot portion which is in surrounding relation to the second recess; and a shell that extends along an underside of the insole, the shell extending under the mid-foot portion, the shell being made of a resilient material that is stiffer than the unitary resilient material.

In accordance with a further aspect of the present invention, footwear is provided including an outer sole; an inner sole as defined above in each occurrence and connected to the outer sole; and an upper connected to at least one of the outer sole and the inner sole.

The above and other features of the invention will become readily apparent from the following detailed description thereof, which is to be read in connection with the accompanying drawings.

DETAILED DESCRIPTION

Figure 1:
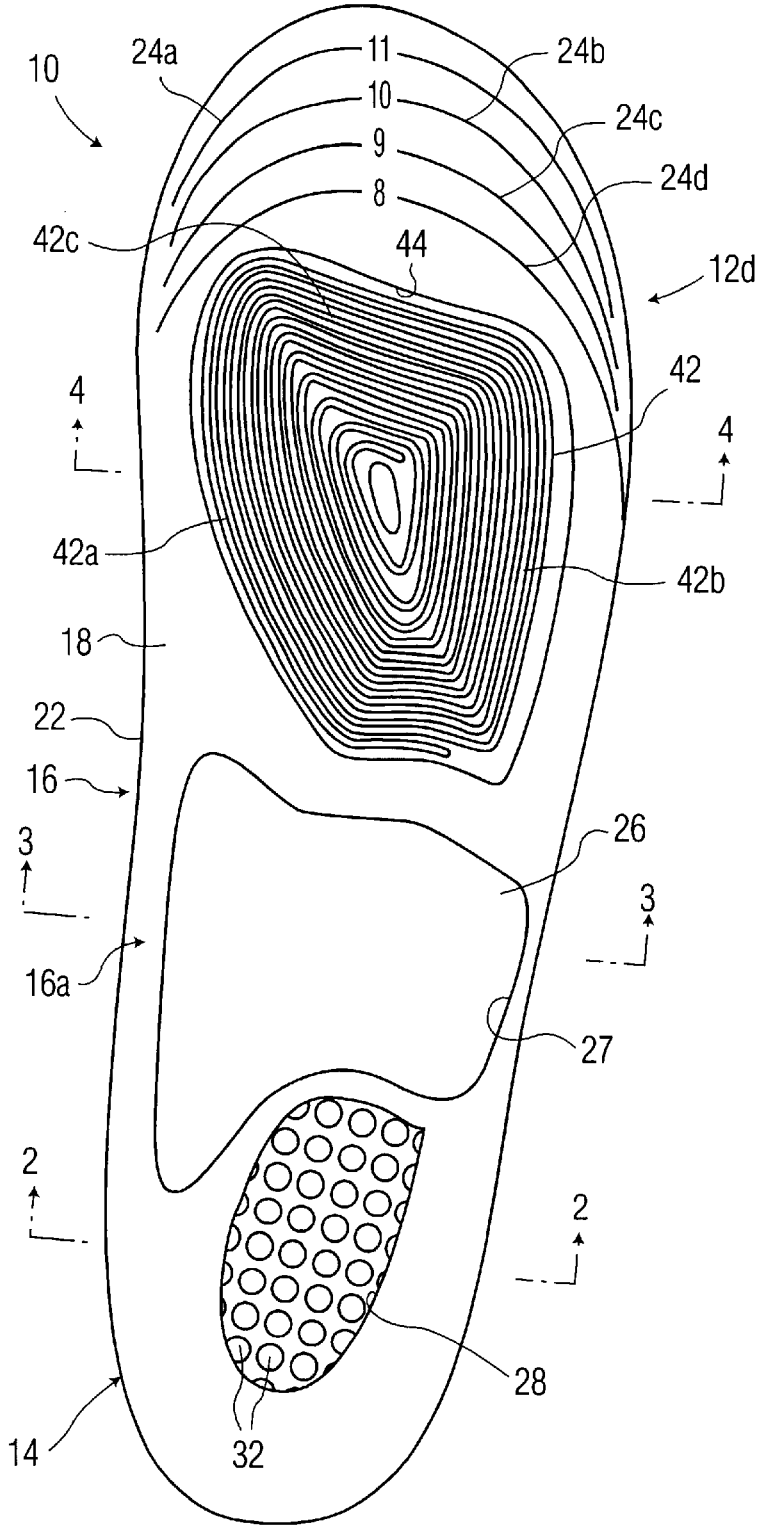
FIG. 1 is a bottom perspective view of a left insole according to the present invention.
Figure 2:
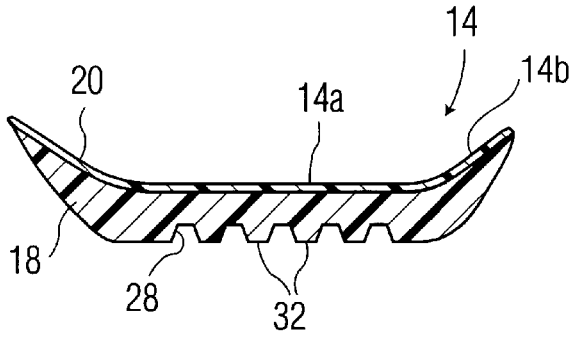
FIG. 2 is a cross-sectional view of the left insole, of substantially actual size, taken along line 2—2 of FIG. 1.

Referring to the drawings in detail, a left insole 10 according to a first embodiment of the present invention is adapted to be placed in an article of footwear, as is well known. A right insole (not shown) is identical to left insole 10 and is a mirror image thereof. Insole 10 is particularly adapted for fitness and recreational walking.

Insole 10 has the shape of a human left foot and therefore includes a curved toe or forefoot portion 12, a heel portion 14, and a mid-foot portion 16 which connects forefoot portion 12 and heel portion 14 together. Heel portion 14 has a greater thickness than forefoot portion 12. For example, heel portion 14 may have a thickness in the range of about 0.16 inch to 0.25 inch for men's insoles and in the range of about 0.16 inch to 0.24 inch for women's insoles, while forefoot portion 12 may have a thickness in the range of about 0.12 inch to 0.22 inch for men's insoles and in the range of about 0.12 inch to 0.20 inch for women's insoles.

Insole 10 is formed by a lower cushioning layer 18 and a top cover 20 secured to the upper surface of cushioning layer 18, along forefoot portion 12, cupped heel portion 14 and mid-foot portion 16, by any suitable means, such as adhesive, RF welding, etc.

Cushioning layer 18 can be made from any suitable material including, but not limited to, any flexible material which can cushion and absorb the shock from heel strike on the insole. Suitable shock absorbing materials can include any suitable foam, such as but not limited to, cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50 degrees ° C. to 100 degrees ° C. may also be advantageously employed. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; MDI diisocyanate prepolymer XAS 10971.02 and polyol blend XUS 18021.00 available from the Dow Chemical Company, Midland, Mich.; and Niax 34-28, available from Union Carbide, Danbury, Conn. These urethane systems generally contain a surfactant, a blowing agent, and an ultra-violet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa.; Fomrez UL-38, a stannous octoate, from the Witco Chemical Co., New York, N.Y. or A-1 (CAS 3033-62-3) available from OSI Corp., Norcross, Ga. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. Suitable surfactants include DC-5169 (a mixture), DC190 (CAS68037-64-9), DC197 (CAS69430-39-3), DC-5125 (CAS 68037-62-7) all available from Air Products Corp., Allentown Pa. and L-5302 (CAS trade secret) from Union Carbide, Danbury Conn. Alternatively, lower layer 18 can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers).

Preferably, cushioning layer 18 is made from a urethane molded material, and more preferably, a polyurethane elastomer material, with a Shore "00" durometer hardness in the range of approximately 45–55. This provides good cushioning for the foot. The lower durometer range as compared to conventional insoles, provides appropriate cushioning for the lower pressure loading associated with fitness walking, as compared to the higher pressure loading associated with running. The foam material also resists significant compression set, thereby maintaining sufficient cushioning throughout the life of the insert.

The materials of lower layer 18 can be prepared by conventional methods such as heat sealing, ultrasonic sealing, radio-frequency sealing, lamination, thermoforming, reaction injection molding, and compression molding and, if necessary, followed by secondary die-cutting or in-mold die cutting. Representative methods are taught, for example, in U.S. Pat. Nos. 3,489,594; 3,530,489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, New Jersey, whose preparative teachings are incorporated herein by reference. For example, the innersole can be prepared by a foam reaction molding process such as taught in U.S. Pat. No. 4,694,589.

Top cover 20 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top cover 20 include good durability, stability and visual appearance. It is also desirable that top cover 20 have good flexibility, as indicated by a low modulus, in order to be easily moldable. The bonding surface of top cover 20 should provide an appropriate texture in order to achieve a suitable mechanical bond to the upper surface of lower layer 18. Preferably, the material of top cover 20 is a fabric, such as a brushed knit laminate top cloth (brushed knit fabric/urethane film/non-woven scrim cloth laminate) or a urethane knit laminate top cloth. Top cover 20 can be made from a polyester fabric material, and preferably has a thickness of about 0.02 inch.

Preferably, top cover 20 is made from a combination of an ethylene vinyl acetate (EVA) synthetic rubber composite, a polyolfenic elastomer material sold by Dow Chemical Company of Midland, Mich. under the trademark "ENGAGE," and a synthetic rubber. This material will resist abrasive wear associated with rigorous walking routines.

During use, insole 10 is placed in a shoe so that the medial side 22 containing a raised medial arch portion 16*a* of mid-foot portion 16 rests against the inside of the shoe. Forefoot portion 12 may end just in front of the metatarsals. Insole 10 is a full length insole, that is, extends along the entire foot.

Typically, insole 10 would be sized corresponding to shoe sizes and would be provided in sized pairs. Alternatively, insole 10 may be trimmed to the requirements of the user. In this regard, arcuate pattern trim lines 24*a*–24*d* may be formed on the lower surface of forefoot portion 12 of insole 10, as shown in FIG. 1, and which are representative of various sizes of the human foot. For example, insole 10 may be provided for a man's shoe size of 12, with first continuous pattern trim line 24*a* being representative of a smaller size insole for a man's shoe size 11, second continuous pattern trim line 24*b* extending around the periphery of forefoot portion 12 indicative of another size of insole for a man's shoe size 10, third continuous pattern trim line 24*c* extending around the periphery of forefoot portion 12 indicative of another size of insole for a man's shoe size 9, and fourth continuous pattern trim line 24*d* extending around the periphery of forefoot portion 12 indicative of another size of insole for a man's shoe size 8. If the user requires a size other than the original large size, the wearer merely trims the insole with a scissors or cutting instrument, using pattern trim lines 24*a*–24*d*, to achieve the proper size. The pattern trim lines may be imprinted by conventional printing techniques, silkscreening and the like. As an alternative, pattern trim lines 24*a*–24*d* may be formed as shallow grooves, or be perforated, so that a smaller size insole may be separated by tearing along the appropriate trim lines, which tearing operation is facilitated by the inclusion of perforations. Thus, forefoot portion 12 can be trimmed so that forefoot portion 12 fits within the toe portion of a shoe.

A cup-shaped arrangement is also provided for the heel and mid-foot in order to stabilize the mid-foot and heel, while at the same time, providing overall cushioning and shock absorption of the mid-foot and heel. This is because there are joints in the mid-foot area and heel. If the foot is not stabilized, that is, without undue side to side movement, there may be pain due to the excessive joint forces.

Specifically, as shown, heel portion 14 includes a relatively flat central portion 14*a*, and a sloped side wall 14*b*. Generally, when a heel strikes a surface, the fat pad portion of the heel spreads out. The cupped heel portion thereby stabilizes the heel of the person and maintains the heel in heel portion 14, to prevent such spreading out of the fat pad portion of the heel, and to also prevent any side to side movement of the heel in heel portion 14.

The side wall 14*b* of heel portion 14 extends forwardly to the mid-foot as a flange or side wall on the lateral and medial sides of mid-foot portion 16, with this side wall extending to a further extent forwardly at the medial side 22 to correspond to the medial arch portion 16*a* thereat.

In accordance with the present invention, thin and spaced apart elastic and resilient spring walls 42 are formed in a repeating order within a recess 44 formed in toe portion 12. Recess 44 occupies a substantial central area of toe portion 12, with thin spring walls 42 extending substantially in a spiral manner therein. The outer peripheral shape of recess 44 ensures that thin spring walls 42 extend under all metatarsal heads, and therefore, occupy a greater lateral to medial area at the front thereof than at the rear thereof. This is also because there is not as much loading toward the arch area, and specifically, approximately 95% of pressure occurs at the metatarsal heads.

Figure 4:
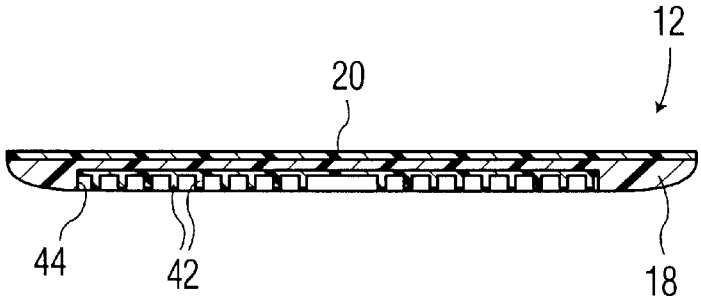
FIG. 4 is a cross-sectional view of the left insole, of substantially actual size, taken along line 4—4 of FIG. 1.

The height of spring walls 42 is substantially the same as the height of recess 44 so that lower edges of thin spring walls 42 are substantially coplanar with the lower surface of insole 10, as shown best in FIG. 4. In the disclosed embodiment, thin spring walls 42 and recess 44 each have a height of approximately 1 mm and a thickness or width of approximately 1.5 mm, while the height of lower layer 18 in surrounding relation to recess 44 has a height of approximately 2 mm and top cover has a height of approximately 1 mm.

The reason for providing thin, spaced apart spring walls 42 in recess 44 of toe portion 12 is that this is an area where the major forces are exerted on insole 10 during push off. With this arrangement, thin flexible and resilient spring walls 42 are elastic and provide the function of a quick acting spring. When the foot first impacts the forefoot portion, the foot acts to apply a load and the gel material functions to absorb the shock. As the foot moves to push off, and particularly, when the forefoot recedes from insole 10, thin spring walls 42 return some of the spring action to the forefoot, giving the foot a softer impact and a springy push off.

The gel which forms spring walls 42 is preferably made from a non-foam elastomer such as the class of materials known as viscoelastic polymers or silicone gels, which show high levels of damping when tested by dynamic mechanical analysis performed in the range of −50° C. to 100° C. Because the mechanical properties of the gel are more viscous than elastic, the gel provides a high energy absorption. Gels that can be used according to the present invention are thermoplastic elastomers (elastomeric materials), such as materials made from many polymeric families, including but not limited to the Kraton family of styrene-olefin-rubber block copolymers, thermoplastic polyurethanes, thermoplastic poly olefins, polyamides, polyureas, polyesters and other polymer materials that reversibly soften as a function of temperature. The preferred elastomer is a Kraton block copolymer of styrene/ethylene-co-butylene/styrene or styrene/butadiene/styrene with mineral oil incorporated into the matrix as a plasticizer.

The spiral shape shown in FIG. 1 is the preferred shape, but the present invention is not limited thereby. The spiral pattern provides a distinct advantage in operation. Specifically, as the foot travels from heel to toe, there is initially a side to side movement of the foot at the rear portion of recess 44, that is, from the medial side toward the lateral side, in order to position the foot for maximum toe push-off. Thus, as the foot transfers weight from heel to toe, the side to side movement flexes the lengthwise extending portions 42*a* and 42*b* of spring walls 42, which absorb the impact and thereby reduce or mitigate lateral motion shear. In actuality, portion 42*a* has a lateral or side to side extending component as well, although it extends primarily in the lengthwise direction of insole 10. When the foot has been shifted so that the major weight is over the metatarsal heads, the push-off is substantially only a push-off in the direction of the anterior to the posterior, with minimal lateral component. In this case, the front portion 42*c* of spring walls 42 are oriented in a side to side or transverse direction. As a result, the shear reduction or mitigation again is provided by the spring walls 42, with maximum effect.

Figure 3:
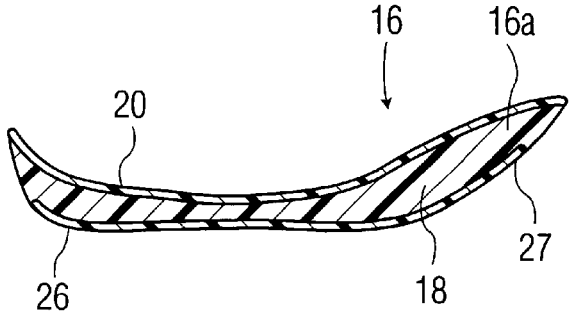
FIG. 3 is a cross-sectional view of the left insole, of substantially actual size, taken along line 3—3 of FIG. 1.

In accordance with another aspect of the present invention, a comprehensive mid-foot arch thin shell 26 of about 0.04 inch or 40 mils (1 mm) uniform thickness is provided on the underside of insole 10 along mid-foot portion 16. The thickness of shell 26 is exaggerated in FIG. 3 for better explanation. Shell 26 is made of a more rigid or stiffer material than lower cushioning layer 18 and provides extra support. Thus, while lower cushioning layer 18 is made from a resilient and deformable foam material, shell 26 is made from a flexible, stiffer thermoplastic composite polymer formed primarily from filaments of fiberglass embedded in a thermoplastic material. However, shell 26 is also flexible in all directions.

Shell 26 can also be made of any flexible material including but not limited to injection molded thermoplastic elastomers such as thermoplastic urethane, thermoplastic polyethylene or other injection molded polymers, and polymers that can be thermoformed such as ethylene vinyl acetate (EVA) or nylons.

Shell 26 aids in defining a more substantial raised arch portion 16*a* which delivers firm support, while allowing full flexibility necessary for adequate pronation from heel strike through the mid-stance of the gait cycle. The more rigid material of shell 26 thereby functions to deter roll out during the heel strike, thereby forcing the person to roll forward rather than sidewards. This is due to the stiffer material of shell 26 used therewith. Specifically, shell 26 aids in the normal pronation of the foot. If the foot overpronates, which often occurs and whereby the arch area overexerts during pronation, the person gets shin splints, and foot and leg fatigue. Therefore, shell 26 provides sufficient arch support, while still providing sufficient flexibility to enable normal pronation, while eliminating foot and leg fatigue.

In this regard, it is noted that the present invention does not permit much lateral movement of the foot, but does provide much lateral support. Rather, the present invention provides more medial support, and in this regard, shell 26 extends to a higher extent on the medial side. This is because there is not much action on the lateral side of mid-portion 16, during fitness and recreational walking, as compared to more vigorous activities such as jogging, basketball, etc.

which tend to push the foot out to the lateral side. Therefore, the major emphasis of support with shell 26 is on the medial side. In an alternative embodiment, the shell can be higher on the lateral side relative to the medial side.

In order to form shell 26 with bottom layer 18, bottom layer 18 is formed with a shallow recess 27 of the same shape and thickness of shell 26. Then, shell 26 is separately formed from a sheet of material and die cut into the desired shape. The formed shell is then adhered within recess 27, such that the lower surface of shell 26 forms a continuation of the lower surface of bottom layer 18.

In accordance with a further aspect of the present invention, an oval opening 28 at the underside of heel portion 14 includes equally spaced apart small protuberances 32. Preferably, protuberances 32 have a cylindrical configuration of approximately 0.19–0.24 inch (5 to 6 mm) diameter and a height of about 0.04–0.08 inch (1 to 2 mm), although the present invention is not limited thereby. For example, protuberances 32 can have other dimensions and other configurations such as square, triangular or polygonal cross-sectional columnar shapes, or other shapes, such as spaced apart sinusoidal walls or the like. The lower ends of protuberances 32 are substantially coplanar with the lower surface of insole 10. Protuberances 32 effectively form spaced apart, elastic, resilient spring walls.

The reason for providing protuberances 32 in recess 34 of heel portion 14 is that this is an area where major forces are exerted on insole 10 during heel impact. With this arrangement, protuberances 32 provide a quicker acting spring than the remainder of insole 10, but with less dampening energy absorption. Thus, when a force is applied to protuberances 32, the response is more like a spring than as a damper, while the remainder of lower cushioning layer 18 has an opposite response, that is, acting more like a damper than a spring, with the exception of spring walls 42, as discussed above. This combination gives insole 10 a unique feature of a fast reaction on first heel impact and a slower higher damped energy absorption as the heel recedes into insole 10. When the heel recedes from insole 10, the reverse action occurs, that is, protuberances 32 return some of the spring action to the heel. When the foot moves to push off, the action of insole 10 is the same as with spring walls 42.

Protuberances 32 also function to absorb shear from any sidewards movement of the foot on insole 10.

Although the present invention uses the term insole, it will be appreciated that the use of other equivalent or similar terms such as innersole or insert are considered to be synonymous and interchangeable, and thereby covered by the present claimed invention.

Further, although the present invention has been discussed in relation to a removable insole, it can be incorporated as a permanent inner sole in footwear, such as a shoe or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A removable insole for insertion into footwear, comprising:

a forefoot portion extending at least to metatarsals of a foot;

a cupped heel portion including a relatively flat central portion and a sloped side wall surrounding said relatively flat central portion;

a mid-foot portion connecting together said forefoot portion and said heel portion, said mid-foot portion including a medial arch portion defined by an extension of said sloped side wall, and said forefoot portion, heel portion and mid-foot portion formed from a unitary resilient material;

a recess in a lower surface of said forefoot portion, said recess having a peripheral side wall and a top wall;

a continuous spring wall formed from a viscoelastic gel in said recess, wherein said continuous spring wall forms a plurality of columns that are spaced apart from one another and said plurality of columns are formed in a generally spiral shape, said continuous spring wall having a lower edge generally coplanar with a lower surface of said forefoot portion which is in surrounding relation to said recess; and a shell that extends along an underside of said insole, said shell extending under said mid-foot portion, said shell being made of a resilient material that is stiffer than said unitary resilient material, wherein said shell is made from a thermoplastic composite polymer formed primarily from filaments of fiberglass embedded in a thermoplastic material.

2. A removable insole according to claim 1, wherein said spring wall extends under said forefoot portion at a position where all metatarsal heads are adapted to apply pressure thereto.

3. A removable insole according to claim 1, wherein said recess occupies a greater lateral to medial area at a front thereof than at a rear thereof.

4. A removable insole according to claim 1, wherein said spring wall extends substantially in an anterior to posterior direction from a rear portion of the recess to a front portion of the recess, and extend substantially in a medial to lateral direction at the front portion of the recess.

5. A removable insole according to claim 4, wherein said spring wall at a medial side of said insole extends at an inclination to said anterior to posterior direction so as to have a substantially anterior to posterior component, wherein said spring wall has a medial to lateral component.

6. A removable insole according to claim 1, wherein said shell extends to a higher extent on a medial side of said mid-foot portion than at a lateral side of said mid-foot portion.

7. A removable insole according to claim 1, wherein said unitary resilient material at said mid-foot portion is formed with a shallow recess at an underside thereof, and said shell is adhered in said shallow recess such that a lower surface of said shell forms a continuation of a lower surface of a remainder of said mid-foot portion surrounding said shallow recess.

8. A removable insole according to claim 1, wherein said cupped heel portion has a first recess at an undersurface of said cupped heel portion;

a plurality of protuberances in said first recess, said protuberances forming spaced apart spring walls and said first protuberances having lower edges generally coplanar with a lower surface of said heel portion in surrounding relation to said first recess.

* * * * *